US006817353B2

(12) United States Patent
Atkinson et al.

(10) Patent No.: US 6,817,353 B2
(45) Date of Patent: Nov. 16, 2004

(54) FRONT SERVICEABLE IGNITION SYSTEM FOR A COOKING APPLIANCE

(75) Inventors: Wade A. Atkinson, Ooltewah, TN (US); Mark A. Pickering, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/410,275

(22) Filed: Apr. 10, 2003

(65) Prior Publication Data

US 2004/0200469 A1 Oct. 14, 2004

(51) Int. Cl.[7] ..... F24C 3/00

(52) U.S. Cl. ..... 126/39 E; 126/39 R; 431/264; 431/266

(58) Field of Search ..... 126/39 E, 39 R, 126/41 R, 39 H, 39 N, 39 K; 431/264, 266, 263, 354; 239/552, 567

(56) References Cited

U.S. PATENT DOCUMENTS

| | | | | |
|---|---|---|---|---|
| 4,518,346 A | * | 5/1985 | Pistien | 431/266 |
| 4,846,671 A | | 7/1989 | Kwiatek | |
| 5,085,202 A | | 2/1992 | Riehl | |
| 5,152,276 A | | 10/1992 | Brock et al. | |
| 5,160,255 A | | 11/1992 | Sigler | |
| 5,160,256 A | | 11/1992 | Riehl | |
| 5,443,380 A | | 8/1995 | Riehl | |
| 5,464,345 A | | 11/1995 | Kwiatek | |
| 5,468,145 A | | 11/1995 | Ferlin | |
| 5,628,302 A | | 5/1997 | Schatz et al. | |
| 5,846,071 A | | 12/1998 | Sigler | |
| 5,924,860 A | | 7/1999 | Massey et al. | |
| 5,934,896 A | | 8/1999 | Kwiatek | |
| 5,961,311 A | | 10/1999 | Moore, Jr. | |
| 6,017,211 A | * | 1/2000 | Gort et al. | 431/266 |
| 6,059,479 A | | 5/2000 | Clune | |
| 6,173,708 B1 | | 1/2001 | Arntz et al. | |
| 6,328,556 B1 | | 12/2001 | Somer | |

FOREIGN PATENT DOCUMENTS

| | | | |
|---|---|---|---|
| DE | 2223009 | * 12/1972 | 431/264 |

* cited by examiner

*Primary Examiner*—James C. Young
(74) *Attorney, Agent, or Firm*—Diederiks & Whitelaw, PLC

(57) ABSTRACT

A cooking appliance includes a support frame at least partially defining a cooktop, an orifice holder, an igniter assembly having an attachment bracket and a removable burner base. The orifice holder includes a central projection and a recessed portion through which extends an igniter receiving aperture. The removable burner includes an igniter receiving opening and a central receiving portion adapted to engage with the gas orifice holder through the central projection to form a burner assembly. The igniter is positioned in the igniter receiving aperture with the bracket being secured to the recessed portion of the orifice holder. Once assembly, the burner base is placed over the orifice holder to from a gas burner assembly. Preferably, the igniter is interconnected with an ignition wire having a terminal connector sized to pass through the igniter receiving aperture. With this arrangement, the igniter is installed/removed from a top portion of the cooktop.

26 Claims, 2 Drawing Sheets

FRONT SERVICEABLE IGNITION SYSTEM FOR A COOKING APPLIANCE

BACKGROUND OF THE INVENTION

1. Field of the Invention

The present invention pertains to the art of cooking appliances and, more particularly, to a cooking appliance including a cooktop and a gas igniter assembly that is serviceable through a front or top portion of the cooktop.

2. Discussion of the Prior Art

A typical gas cooking appliance will include a cooktop about which are arrayed a plurality of gas burner assemblies. Customarily, each of the burner assemblies will include an igniter for lighting a gas flow to enable the performance of a cooking process. In general, igniters take on one of two forms. The first, a pilot light, locates a small flame source in a gas flow path common to one or more burners. When a gas flow to one or more of the burners is initiated, the flow is ignited by the small flame source. The second ignition method places an electronic igniter adjacent to each of the plurality of gas burners.

An electronic igniter typically includes a central electrode surrounded by a ceramic covering. More specifically, the central electrode includes a first, exposed end portion positioned adjacent to the gas burner and a second end portion provided with structure adapted to interconnect with an ignition wire. Over time, heat, cooking byproducts and other conditions degrade the igniter. As a result, the igniter is prone to failure or damage and sometimes requires replacement. In most cases, the electronic igniter is mounted to structure maintained below the cooktop, for example, burner support structure or the appliance chassis. Access to the igniter is achieved only after removing all burner grates, burner caps, burner bases and thereafter raising the cooktop. When the cooktop is raised, the first end of the igniter is caused to pass through an associated opening in the cooktop. Unfortunately, while access is provided to the damaged igniter, the act of raising the cooktop may, in fact, damage one or more of the other igniters.

In recognition of this problem, igniter mounting arrangements which enable replacement of the igniter through the top of the cooktop have been proposed in the art. In one example, described in U.S. Pat. No. 6,328,556, an electronic igniter is inserted through an opening extending through a flange projecting from an orifice holder and an associated opening in a flange carried by a base member. While the igniter is installed through the top of the cooktop, and damage associated with lifting the cooktop is eliminated, the igniter is positioned out in the open. With this construction, the igniter is subjected to the total cooking environment and is prone to damage from liquids, contact with cookware, and the like. In another example, described in U.S. Pat. No. 5,160,255, the igniter is fixedly mounted to a burner base through a spring clip. While the igniter can be replaced through the top of the cooktop, access to areas below the cooktop is required to disconnect an ignition wire.

While the above described systems for mounting an igniter through the top of a cooktop are effective to a degree, there still exists a need in the art for a mounting arrangement that permits an igniter for a gas burner to be mounted through the top of the cooktop, while effectively shielding the igniter from the potential harm caused by liquids and other hazards. Moreover, there exists a need for a mounting arrangement that permits the igniter to be replaced without having to raise the cooktop to gain access to wires, fasteners and other associated structure.

SUMMARY OF THE INVENTION

The present invention is directed to a cooking appliance including a support frame at least partially defining a cooktop, a gas orifice holder, an electronic igniter assembly, and a removable burner base. More specifically, the gas orifice holder includes a central projection and a recessed portion through which extends an igniter receiving aperture. The removable burner includes a peripheral support surface, an igniter receiving opening aligned with the igniter receiving aperture, and a central receiving portion adapted to engage with the gas orifice holder, through the central projection, to form a burner assembly.

In accordance with the most preferred form of the invention, the electronic igniter assembly includes an igniter member and an attachment bracket secured to the igniter member. With this construction, the igniter member is inserted through the igniter receiving aperture from a front or top portion of the appliance. The attachment bracket is secured to the recessed portion of the gas orifice through a mechanical fastener such that the igniter is fixed in place. The burner base is then installed over the gas orifice and a burner cap is positioned such that the igniter is protected from spilled liquids and other potential hazards.

In further accordance with the most preferred form of the invention, the igniter member includes a first end including an electrode, and a second end terminating in a terminal connector. A lead or ignition wire is positioned below the cooktop and includes a terminal connector receiving portion sized to pass through the igniter receiving aperture. With this arrangement, the igniter can be removed from the receiving aperture with the ignition wire being of sufficient length to pass to the front portion of the cooktop. Accordingly, installation and/or removal of the igniter can be accomplished without the need to raise the cooktop.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
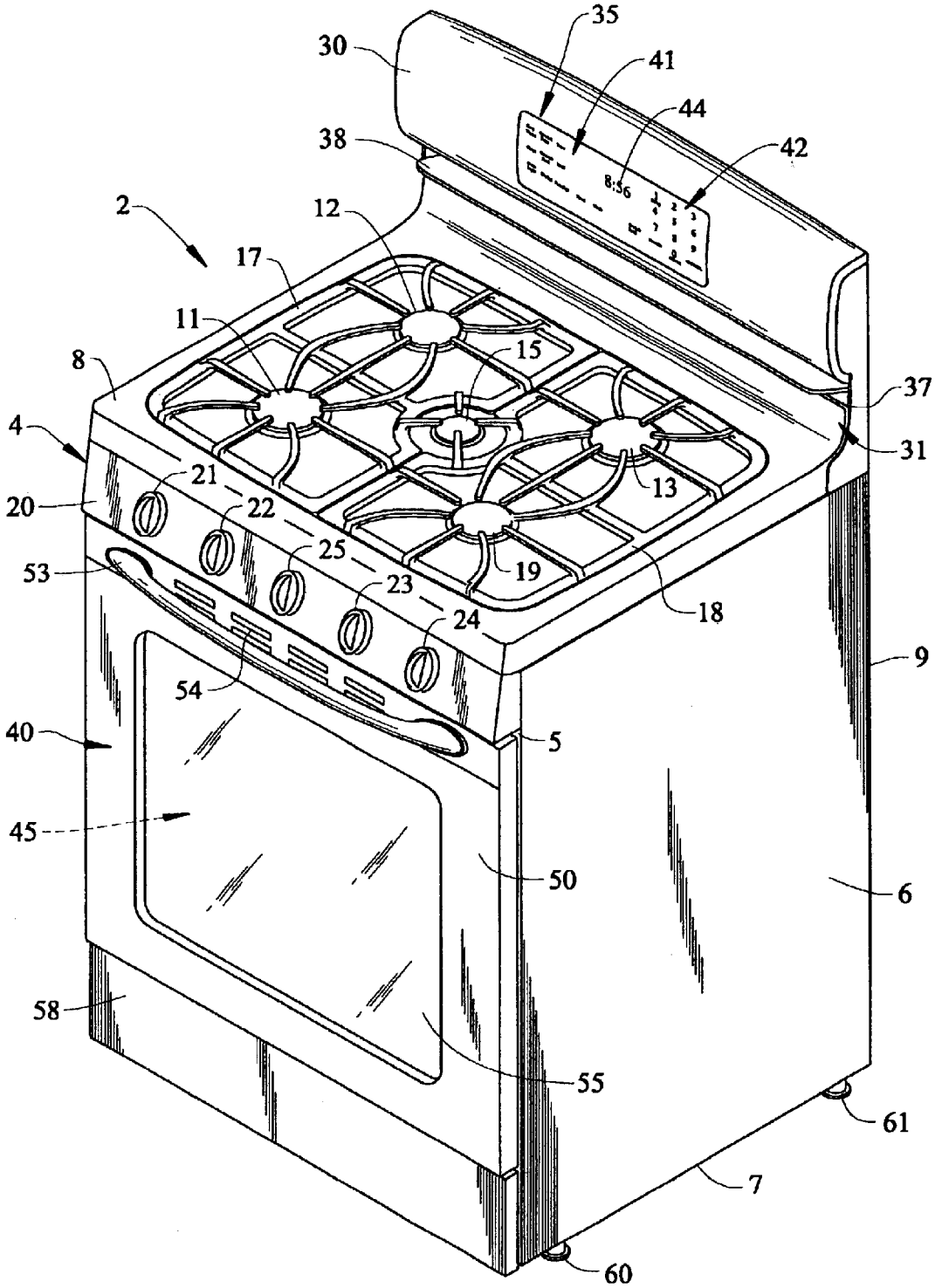
FIG. 1 is an upper right front perspective view of a cooking appliance incorporating a front serviceable ignition system constructed in accordance with the present invention.

With initial reference to FIG. 1, the present invention is preferably incorporated into a cooking appliance generally indicated at 2. As shown, cooking appliance 2 takes the form of a free-standing gas range. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with five gas burner elements 11–15, i.e., four outer quadrant gas burner elements 11–14 and a central gas burner element 15, which are covered by left and right, mirror image burner grates 17 and 18.

In the embodiment illustrated, cabinet 4 further includes a front control surface 20. Preferably, control surface 20 supports a plurality of control knobs 21–25 for controlling the activation/de-activation of gas burners 11–15 respectively. Furthermore, cabinet 4 includes an upstanding control panel 30. In the embodiment shown, control panel 30 includes a central control and display unit, generally indicated at 35, mounted above an exhaust outlet opening 37 extending across upper rear portion 31 of cabinet 4. As shown, an exhaust deflector 38 is provided to redirect hot oven gases away from contact with central control and display unit 35 as well as surface portions of control panel 30. In any event, central control and display 35 is provided for use in controlling an oven 40 of range 2.

Although not fully detailed in this figure, control and display unit 35 includes a first control section 41 for selecting a desired cooking operation for oven 40. For instance, a user can select between keep warm, convection bake, bake, clean convection broil, broil, drying, and bread proofing operations. In connection with setting desired cooking parameters, control and display unit 35 also includes a second control section 42 which defines a numeric key pad. At this point, it should be realized that the arrangement and features associated with control panel 30 can vary without departing from the invention. For instance, in addition to other standard controls, such as timer and clock setting elements, control panel 30 can provide for other operations, such as a "cook and hold" feature wherein oven 40 operates to maintain food cooked therein warm following a cooking operation or a "favorite" selector which can be employed to readily establish a predetermined, preferred cooking sequence for oven 40. In any event, control and display unit 35 further includes a central display 44 for conveying information to and verifying input/operational parameters to a user.

In the preferred embodiment, oven 40 includes an oven cavity 45 which is larger than an oven cavity provided in a standard oven range. More specifically, wherein the volume of an oven cavity for a standard oven range would be in the order of 4.0 cubic feet, oven cavity 45 is approximately 5.2 cubic feet. In accordance with the present invention, oven cavity 45 is preferably formed of metal and coated with a heat resistant material, such as porcelain. In any case, oven 40 has associated therewith a door 50 which can be pivoted by means of a handle 53. Door 50 preferably includes a plurality of vents arranged behind handle 53 and a window 55 for viewing the contents of oven cavity 45 when door 50 is closed. Arranged below door 50 and extending across cabinet 4 is a lower face panel 58.

In a manner known in the art, range 2 is adapted to be mounted upon a supporting surface, such as a kitchen floor or the like. More specifically, a plurality of leg members, two of which are indicated in FIG. 1 at 60 and 61, extend from bottom portion 7 at front and rear portions of cabinet 4, along side panel 6. Of course, corresponding leg members 60 and 61 are also provided on the opposing side of range 2. In any event, the various leg members 60 and 61 are preferably vertically adjustable to also act as levelers for range 2. Such type of leg leveler arrangements are widely known in the art of appliances, including both ranges and refrigerators such that the leveling function of leg members 60 and 61 does not form part of the present invention. Instead, the invention is actually directed to a front serviceable ignition system incorporated into cooking appliance 2 as will be more fully discussed below.

Figure 2:
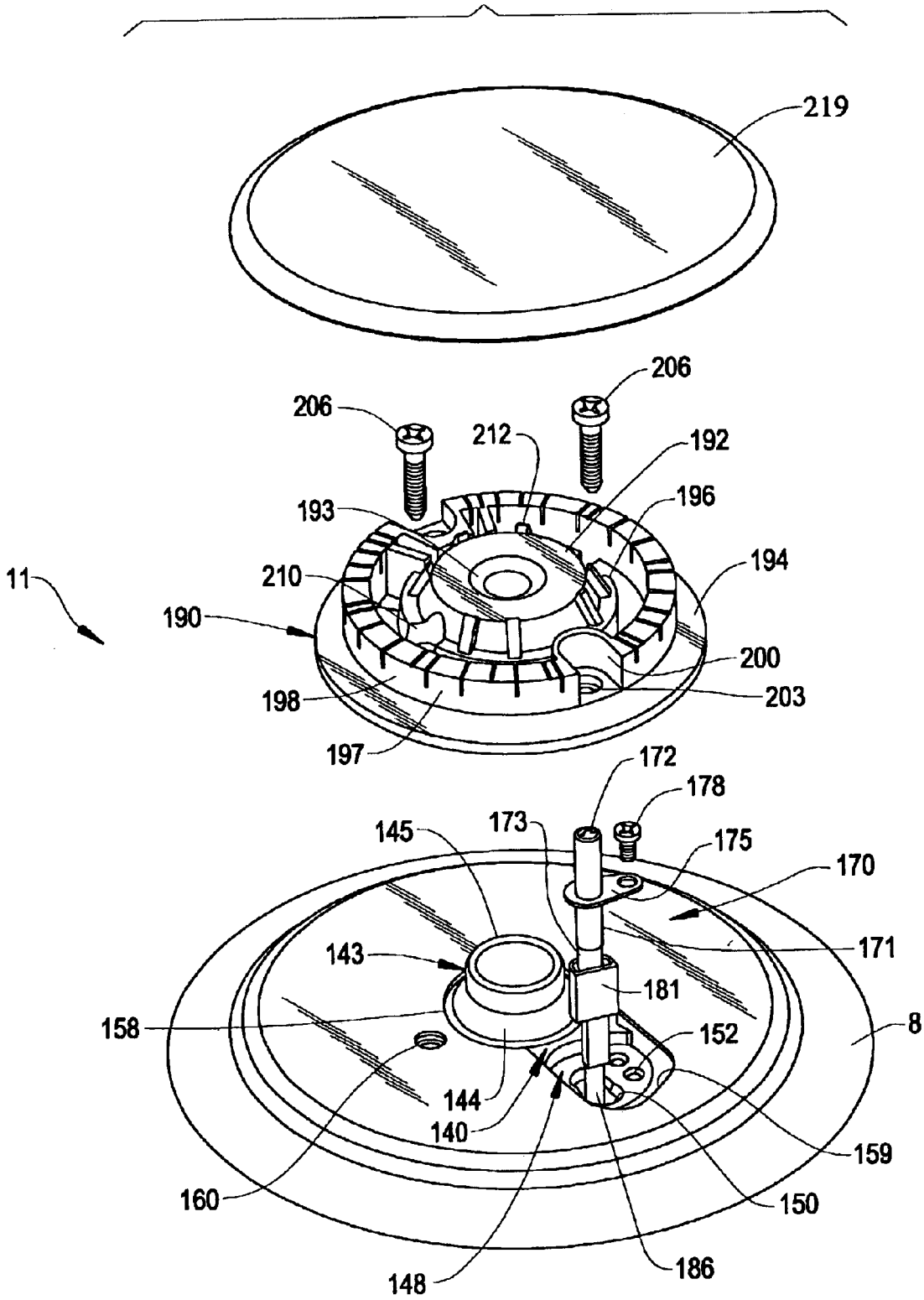
FIG. 2 is a partial exploded view of a gas burner assembly and front serviceable ignition system constructed in accordance with the present invention.

Reference will now be made to FIG. 2 in describing the specific structure of gas burner elements 11–15 and, more particularly, to the ignition system provided with each of gas burners 11–15. Since the structure of each gas burner elements 11–15 and its associated ignition system is identical, a detailed description of gas burner 11 will be made and it is to be understood that gas burners 12–15 have commensurate structure.

In the embodiment illustrated, gas burner 11 includes a gas orifice holder 140 having a central projection 143 including a first or tapered portion 144 extending upward to an annular ring portion 145. In accordance with a preferred form of the invention, gas orifice holder 140 includes an igniter attachment point in a or recessed portion 148, having an igniter receiving aperture 150 and a threaded fastener receiving bore 152, provided adjacent to central portion 143. Actually, a second fastener receiving bore (not separately labeled) is also provided for adjustment purposes. Gas orifice holder 140 is arranged below cooktop 8, with at least a portion of central projection 143 projects through an opening 158 provided in cooktop 8. As shown, opening 158 leads to a lateral igniter opening 159 which exposes recessed portion 148. As will be detailed more fully below, a pair of opposing holes, one of which is indicated at 160, are formed in cooktop 8 radially outwardly of opening 158.

In accordance with the most preferred form of the invention, gas burner 11 includes a gas igniter assembly 170 provided to touch off a gas flow directed through burner element 11. More specifically, gas igniter assembly 170 includes an igniter member 171 having an electrode 172 electrically interconnected to a connector element 173. Preferably, electrode 172 is provided with a ceramic insulator (not separately labeled) having secured thereto a bracket 175 for mounting igniter assembly 170 within recessed portion 148 of gas orifice holder 140. In the embodiment shown, gas igniter assembly 170 is secured within recess portion 148 with a mechanical fastener 178 adapted to threadably engage with a respective fastener receiving bore 152. As will be detailed more fully below, connector 173 is constituted by a blade-type connector adapted to matingly engage with an associated ignition wire connector 181 provided at an end of an ignition or lead wire 186.

In further accordance with the most preferred form of the invention, gas burner 11 includes a removable burner base member 190. In the embodiment illustrated, base member 190 includes a central portion 192, having a gas outlet opening 193, interconnected with a peripheral support 194 through an intermediate portion 196. More specifically, base member 190 includes an upwardly projecting flange member 197 having arranged thereabout a plurality of flame outlet ports, one of which is indicated at 198. In the most preferred form, flange member 197 includes at least one notched section 200 provided with an igniter opening 203. Base member 190 is adapted to be positioned atop gas orifice holder 140, with central projection 143 extending into central portion 192, and gas igniter assembly 170 being positioned such that electrode 172 passes through igniter passage 203. Base member 190 is thereafter secured to gas orifice holder 140 by a plurality of mechanical fasteners 206. More specifically, a pair of opposing mounting apertures 210 are arranged between central portion 192 and flange member 197 enabling mechanical fasteners 206 to pass through base member 190, openings 160 in range top 8 and to be threadably engaged in respective openings (not labeled) in gas orifice holder 140. Finally, gas burner assembly 190 includes a plurality of circumferentially spaced, upstanding projections 212 extending about central portion 192 which provide support for a burner cap 219.

With this construction, it should be readily apparent that gas igniter assembly 170 can be easily replaced through the front or top portion of range top or cooktop 8. In the event that gas igniter assembly 170 experiences a failure, a service technician can easily replace the failed component. To gain access to igniter assembly 170, burner grate 17 and burner cap 219 are removed from range top 8. In this manner, mechanical fasteners 206 can be readily accessed and removed, thus enabling burner base member 190 to be lifted from cooktop 8 to expose gas igniter assembly 170. With gas igniter assembly 170 exposed, fastener 178 is removed from bracket 175 enabling electrode 172 to be lifted from recessed portion 148 in gas orifice holder 140. In the most preferred form of the invention, igniter receiving aperture 150 is sized and ignition wire 186 is of sufficient length to allow connector 181 to pass through igniter receiving aperture 150. Therefore, a technician can easily remove blade 173 from connector 181. At this point, a new igniter assembly 170 can be connected to ignition wire 186 through connector 181 and the above described steps reversed to reassemble gas burner 11.

With this construction, igniter assembly 170 is inserted through the igniter receiving aperture 150 from a front or top portion of cooking appliance 2, thereby making removal and/or installation significantly easier for a service technician. Moreover, by not requiring range top 8 be raised during the removal and/or installation process, other igniter assemblies need not be disturbed and potentially damaged. Finally, once igniter assembly 170 and base burner 190 are installed, burner cap 219 is re-positioned to provide protection for igniter assembly 170 from spilled liquids and other potential hazards.

Although described with reference to a preferred embodiment of the present invention, it should be readily apparent of one of ordinary skill in the art that various changes and/or modifications can be made to the invention without departing from the spirit thereof. For instance, while the igniter is described as being an electrode encased in ceramic, various other types of insulation material could be used. In addition, despite the fact that the cooking appliance is illustrated as a free-standing oven range, the present invention could be easily incorporated into other types of appliance, for example kitchen island and cooktops and slide-in ranges. In general, the invention is only intended to be limited to the scope of the following claims.

We claim:

1. A cooking appliance comprising:

a cooktop having arranged thereabout a plurality igniter openings adjacent to a plurality of burner openings; and a plurality of gas burner assemblies, each of the plurality of gas burner assemblies including:

a gas orifice holder arranged below the cooktop, said gas orifice holder including a gas delivery portion for directing a gas supply through a respective one of the plurality of spaced burner openings, and an igniter receiving aperture arranged adjacent to the gas delivery portion;

a gas igniter assembly including an igniter member positioned in the igniter receiving aperture; and a removable burner base member having a peripheral support surface, an igniter receiving opening receiving the igniter member, and a gas receiving portion aligned with the gas delivery portion of the gas orifice holder, wherein removing the burner base member from the gas orifice holder exposes the igniter receiving aperture to enable removal of the igniter assembly through the cooktop.

2. The cooking appliance according to claim 1, further comprising:

a terminal connector attached to an end portion of the igniter member; and an ignition wire connected to the terminal connector, said terminal connector being sized to pass through the igniter receiving aperture.

3. The cooking appliance according to claim 1, wherein the gas delivery portion is constituted by a central projection including a first tapered portion and an annular ring.

4. The cooking appliance according to claim 1, wherein the gas orifice holder includes a recessed portion arranged adjacent to the gas delivery portion of the gas orifice holder, said recessed portion having arranged therein the igniter receiving aperture.

5. The cooking appliance according to claim 4, wherein the gas igniter assembly includes an attachment bracket secured to the igniter member, said attachment bracket being adapted to be positioned in the recessed portion of the gas orifice holder.

6. The cooking appliance according to claim 5, wherein each igniter opening constitutes a lateral opening extending from a respective one of the plurality of burner openings in the cooktop, said lateral opening exposing the recessed portion and the igniter receiving aperture.

7. The cooking appliance according to claim 5, when the attachment bracket includes an elongated portion extending from the igniter member, said elongated portion being received in the recessed portion and including an opening for receiving a fastener.

8. The cooking appliance according to claim 1, wherein the burner base member includes an upwardly projecting flange member having a plurality of flame outlet ports, said upwardly projecting flange member including a notched section within which is provided the igniter receiving opening.

9. The cooking appliance according to claim 8, further comprising: a pair of opposing mounting apertures arrange in the burner base member, said mounting apertures receiving respective fasteners for removably attaching the burner base member to the gas orifice holder through the cooktop.

10. The cooking appliance according to claim 9, wherein the burner base member includes an intermediate portion having a plurality of upstanding projections, said cooking appliance further comprising a burner cap supported by the plurality of upstanding projections over the burner base member.

11. The cooking appliance according to claim 1, wherein the cooking appliance constitutes a range.

12. A cooking appliance comprising:

a cooktop having arranged thereabout a plurality of igniter openings adjacent to a plurality of burner openings;

a gas orifice holder arranged below the cooktop, said gas orifice holder including a gas delivery portion provided for directing a gas supply through one of the plurality of burner openings, and an igniter receiving aperture arranged adjacent to the gas delivery portion;

a gas igniter assembly including an igniter member having a first terminal connecting portion;

a lead wire having a second terminal connecting portion interconnected with the first terminal connecting portion of the igniter member, said first and second terminal connecting portions being sized to pass through the igniter receiving aperture; and a removable burner base member having a peripheral support surface covering a substantial portion of a respective one of the igniter openings, an igniter receiving opening receiving the igniter member, and a gas receiving portion aligned with the gas delivery portion of the gas orifice holder, wherein removing the burner base member from the gas orifice holder exposes the igniter receiving aperture to enable removal of the igniter assembly through the cooktop.

13. The cooking appliance according to claim 12, wherein said first and second terminal connecting portions being sized to pass through the igniter receiving aperture.

14. The cooking appliance according to claim 12, wherein the gas delivery portion is constituted by a central projection including a first tapered portion and an annular ring.

15. The cooking appliance according to claim 12, wherein the gas orifice holder includes a recessed portion arranged adjacent to the gas delivery portion of the gas orifice holder, said recessed portion having arranged therein the igniter receiving aperture.

16. The cooking appliance according to claim 1, wherein the gas igniter assembly includes an attachment bracket secured to the igniter member, said attachment bracket being adapted to be positioned in the recessed portion of the gas orifice holder.

17. The cooking appliance according to claim 16, wherein each igniter opening constitutes a lateral opening extending from a respective one of the plurality of burner openings in the cooktop, said lateral opening exposing the recessed portion and the igniter receiving aperture.

18. The cooking appliance according to claim 16, wherein the attachment bracket includes an elongated portion extending from the igniter member, said elongated portion being received in the recessed portion and including an opening for receiving the fastener.

19. The cooking appliance according to claim 12, wherein the burner base member includes an upwardly projecting flange member having a plurality of flame outlet ports, said upwardly projecting flange member including a notched section within which is provided the igniter receiving opening.

20. The cooking appliance according to claim 19, further comprising: a pair of opposing mounting apertures arrange in the burner base member, said mounting apertures receiving respective fasteners for removably attaching burner base member to the gas orifice holder.

21. The cooking appliance according to claim 20, wherein the burner base member includes an intermediate portion having a plurality of upstanding projections, said cooking appliance further comprising a burner cap supported by the plurality of upstanding projections over the burner base member.

22. The cooking appliance according to claim 12, wherein the cooking appliance constitutes a range.

23. A method of replacing an igniter of a gas burner assembly of a cooking appliance including a cooktop comprising:

removing a burner base member from upon the cooktop to expose an igniter attachment point located below the cooktop;

disconnecting the igniter from the igniter attachment point, wherein disconnecting the igniter from the igniter attachment point constitutes removing a fastener holding a bracket, which is carried by the igniter, from a gas orifice holder arranged below the cooktop;

withdrawing the igniter through the cooktop;

attaching a new igniter to the igniter attachment point; and replacing the burner base member upon the cooktop with the burner base member extending over a substantial portion of the igniter attachment point.

24. The method of claim 23, wherein attaching the new igniter constitutes securing the bracket in a recessed portion of the gas orifice holder.

25. The method of claim 24, wherein the step of withdrawing the igniter initially requires pulling the igniter through an igniter receiving aperture extending through the recessed portion of the gas orifice holder.

26. The method of claim 25, further comprising: causing an electrical connector to pass the igniter receiving aperture when withdrawing the igniter through the cooktop.

* * * * *